US005363524A

United States Patent [19]

Lang

[11] Patent Number: 5,363,524

[45] Date of Patent: Nov. 15, 1994

[54] MULTI-ADJUSTMENT CERVICAL PILLOW

[75] Inventor: Gary E. Lang, Garden Grove, Calif.

[73] Assignee: Makura Corporation, Garden Grove, Calif.

[21] Appl. No.: 112,416

[22] Filed: Aug. 26, 1993

[51] Int. Cl.[5] ..... A47G 9/00

[52] U.S. Cl. ..... 5/640; 5/644; 5/645; 5/458

[58] Field of Search ..... 5/448, 458, 911, 636, 5/640, 641, 644, 645

[56] References Cited

U.S. PATENT DOCUMENTS

| | | | |
|---|---|---|---|
| 1,068,355 | 7/1913 | McComb | 5/640 |
| 1,447,288 | 3/1923 | Emmerich | 5/645 |
| 2,500,974 | 3/1950 | Angert | 5/645 |
| 3,327,330 | 6/1967 | McCullough | 5/640 |
| 3,604,026 | 9/1971 | Schleps | 5/640 X |
| 4,780,921 | 11/1988 | Lahn et al. | 5/644 X |
| 5,088,141 | 2/1992 | Meyer et al. | 5/636 |

FOREIGN PATENT DOCUMENTS

| | | | |
|---|---|---|---|
| 2030448 | 4/1980 | United Kingdom | 5/640 |

*Primary Examiner*—Michael F. Trettel
*Attorney, Agent, or Firm*—William L. Chapin

[57] ABSTRACT

A pillow adjustable to maximize comfortable support of the cervical area of the neck and head includes a cover comprising upper and lower fabric cover panels forming therebetween an interior space filled with a flowable filler material such as buckwheat hulls. Internally protruding snap fasteners in vertically aligned locations on inner facing sides of the upper and lower cover panels are fastenable and unfastenable by application of external pressing or pulling forces applied to the cover panels, thereby forming or unforming subdivisions of the interior space of the pillow into which filler material may be externally manipulated into or out of. In the preferred embodiment, a rectangular array of fasteners offset to one long side of a rectangular pillow allows narrow or wide tubular neck support sections to be formed by subdivisions within the pillow.

21 Claims, 3 Drawing Sheets

MULTI-ADJUSTMENT CERVICAL PILLOW

BACKGROUND OF THE INVENTION

A. Field of the Invention

This invention relates to pads and pillows for comfortably supporting parts of the human body. More particularly, the invention relates to an adjustable cervical pillow for supporting the head and neck at adjustable relative positions.

B. Description of Background Art

A variety of pillows and pads for supporting the head, neck and other parts of the body are known. For example, pillows having a soft fabric cover and filled with a soft, yielding material such as feathers or down have long been in use. More recently, synthetic filler materials such as polyester fibers have been used as an alternative to down or feathers.

Usually, it is preferable that a pillow provide more support in the neck area than in the head area. Thus, health core professionals have found that a higher degree of neck support relative to head support helps to relieve pain and improve the rate of healing of certain injuries, owing to a reduction in mechanical stress on the muscles, tendons, nerve roots and other soft tissue structures in and around the spinal column.

To provide different degrees of support for the head ant neck, some prior art pillows have been constructed using fillers consisting of synthetic fibers (fiber fill), feathers, or down of various densities and fullness, with special shapes formed in the pillow, usually by sewing the cover to form hollow sections or compartments. However, pillows of this type are not adjustable to suit different users, or for treating different problems, Also, pillows having a fixed configuration generally do not allow the flow of filler material from areas on which high external pressures are imposed by the body, to lower pressure areas which are more lightly loaded by different parts of the body.

Another type of prior art pillow intended to provide varying degrees of support for the head and neck utilizes a foam rubber core of a selected resilience, preformed to a desired shape and size. Some pillows of this type employ replaceable foam inserts. A disadvantage of foam pillows of this type is that they generally must be custom-made to fit different individuals. Also, foam filled pillows tend to compress more in high pressure areas.

Another type of prior art pillow utilizes an inflatable bladder. While such pillows are adjustable in size, they are usually uncomfortable, and have a steep gradient in supporting force from portions of the body contacting the pillow to unsupported portions.

Prior art pillows have also been constructed utilizing a flowable inner filling such as polystyrene beads. Pillows of this type tend to be comfortable, since they conform readily to the contours of the user. However, pillows of this type sometimes may not be supportive enough in the neck area for certain conditions or users, particularly if made into larger sizes for use by larger individuals.

Other types of adjustable pillows known to the present inventor include those described in the following U.S. Patents:

McComb, U.S. Pat. No. 1,068,355, Jul. 22, 1913, Pillow

Discloses a rectangular plan-view pillow having on one external wall a diagonally disposed row of snap fastener heads and on the opposite external wall a row of snap fastener sockets aligned with the heads. The volume of the pillow may be reduced by folding the pillow into a triangular shape along the diagonal, and inserting the fastener heads into aligned sockets.

Barcalo, U.S. Pat. No. 1,890,358, Dec. 6, 1932, Pillow or Cushion

Discloses a pillow having a pair of triangular shaped end walls and rectangular shaped bottom, rear and front side walls. A longitudinally disposed cord running through a pair of aligned buttons, one on each of the triangular side walls, may be pulled taut and tied to compress the pillow longitudinally.

Angert, U.S. Pat. No. 2,500,974, Mar. 21, 1950, Adjustable Pillow

Discloses a pillow adjustable to shift the filling thereof which employs pairs of elliptically shaped, transversely disposed internal valve flaps lying in a vertical plane and overlying one another. The pillow may be distorted to create an opening between adjacent flaps, thereby allowing filling material to move longitudinally to a desired position, whereupon the external distorting force is removed, causing the valve flaps to once again overlap and prevent longitudinal movement of filling material, thereby retaining the adjusted shape of the pillow.

Mueller, U.S. Pat. No. 2,765,480, Oct. 9, 1956, All Purpose Orthopedic Pillow

Discloses a pillow having two similarly shaped elongated stuffed sections joined on long inner lateral edges thereof to opposite edges of a rectangularly shaped flat flexible web section located between the stuffed sections. A pair of snap fasteners on the upper wall of a first stuffed section, adjacent the outer lateral edge wall thereof, is adapted to engage a pair of matching fasteners located on the upper wall of the web, adjacent the junction between the second stuffed section and the web, thus allowing the first stuffed section to be folded over and secured to the web by engaging the fasteners. Similarly, a pair of similarly positioned fasteners on the lower side of the second stuffed section is engageable by a pair of fasteners on the lower wall of the web, thus allowing the second stuffed section to be folded under and secured to the web by engaging the second pair of fasteners.

Thomas, U.S. Pat. No. 4,513,462, Apr. 30, 1985, Therapeutic Pillow

Discloses a therapeutic pillow comprising a soft resilient bottom pillow section and a top pillow section thereover and peripherally interconnected. The top section includes top and bottom fabric covers peripherally interconnected with interior stitching spaced from the sides of the pillow sections interconnecting the covers defining a first tubular neck support of rectangular shape and a supplemental neck support of U-shape. Compacted resilient fiber stuffing is interposed within the neck supports. The bottom section includes a bottom fabric cover peripherally joined to the top section containing a mass of loosely confined resilient fiber stuffing which underlies the top pillow section.

Beier, U.S. Pat. No. 4,756,035, Jul. 12, 1988, Orthopedic Pillow

Discloses an orthopedic pillow comprising an outer pillow case defining first and second compartments therein. A fibrous material is positioned in the first compartment to provide a head cushion. An elongated resilient block member is positioned in the second compartment for supporting a person's neck. The firmness of the head and neck cushion may be selectively varied. O'Sullivan, U.S. Pat. No. 4,768,248, Sep. 6, 1988, Health Pillow Construction And Method Therefor:

Discloses an improved health pillow construction for receiving the head and neck of the user in a resting position comprising a cover having a first and second wall, and a partition interposed between the first and second walls so as to define a first and second chamber, respectively. Soft filler material is enclosed within the first chamber for comfortably supporting the head. Enclosed within the second chamber is a firm neck support member which is slidably moveable within the second chamber, so that the neck support member can easily be shifted from one position to another within the chamber. This enables the user to conveniently adapt the pillow to provide firm support for the neck while providing satisfactory head support. The neck support member is preferably in a cylindrical roll shape and is of a firm material, such as hard latex, or polyester fiber tightly packed within a covered fabric. The neck roll preferably has a diameter approximately in the range of 20 to 30 percent of its height. A method is also disclosed for constructing the improved health pillow.

Sanders, U.S. Pat. No. 4,908,894, Mar. 20, 1990, Adjustable Pillow

Discloses an orthopedic pillow having separately adjustable neckroll and head-support sections. The neckroll section has a foam rubber pad rolled into a spiral roll and housed within a cylindrical case. The case can be opened to allow the pad to be removed and trimmed. The diameter of the neckroll can thus be adjusted to correspond to the contour of the user's neck. The head-support section has an outer section and an inner section. The thickness of the outer portion may be adjusted by adding or removing filler material. The thickness of the inner portion may be adjusted by adding or removing inlays in a stacked arrangement.

The present invention was conceived of to provide an improved pillow having a plurality of selectable configurations to provide varying degrees of support for the head and neck.

OBJECTS OF THE INVENTION

An object of the present invention is to provide a pillow that includes means for maintaining the pillow in a pre-selected one of a plurality of configurations providing varying degrees of support for the head and neck.

Another object of the invention is to provide a multi-adjustment cervical pillow that is externally re-configurable to a variety of pre-determined configurations.

Another object of the invention is to provide an externally re-configurable cervical pillow filled with a flowable filler material, the pillow so constructed as to permit the filler material to be pre-positioned to provide varying degrees of support at different locations on the surface of the pillow, while still allowing some material flow tending to equalize support pressure.

Another object of the invention is to provide a multi-adjustment cervical pillow having a plurality of internal fasteners that are externally operable to vary the configuration of the pillow.

Another object of the invention is to provide a multi-adjustment cervical pillow having a plurality of internal fasteners that may be selectably engaged to provide asymmetrical disposed open and closed inner portions of the pillow.

Another object of the invention is to provide a multi-adjustment cervical pillow having a plurality of internal fasteners disposed asymmetrically with respect to the perimeter of the pillow.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved pad or pillow for comfortably supporting portions of the human body. The pillow according to the present invention includes a generally rectangular shaped cover formed of upper and lower rectangular fabric panels joined on four sides to form an interior space occupied by a filler material. A plurality of spaced apart fastener halves of a first type is provided on the inner surface of the upper cover panel, and a plurality of mating fastener halves of a second type is attached to the inner surface of the lower cover panel, in vertical alignment with fastener halves on the upper cover panel. Selected pairs of internal fastener halves may be engaged by applying external compressive forces on portions of the upper and lower cover panels adjacent the selected fasteners. By this means, the interior space of the pillow may be externally configured to provide subcompartments into which more or less filler material may be moved by external manipulation of the pillow cover. Preferably, the filler material is chosen to be a readily flowable material such as buckwheat hulls. Thus constructed, selected portions of the pillow according to the present invention may be filled to greater or lesser heights to provide comfortable differential support to the neck and head of a user, for example. In the preferred embodiment, the fasteners are located asymmetrically with respect to the perimeter of the pillow, thus facilitating the formation of wider or narrower regions parallel to the edges of the pillow.

DESCRIPTION OF THE PREFERRED EMBODIMENTS

Referring now to FIGS. 1–11 but primarily to FIGS. 1–4, a basic embodiment of a multi-adjustment cervical pillow according to the present invention is shown.

Figure 1:
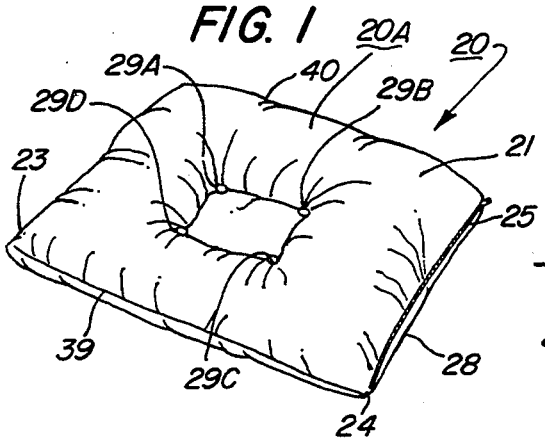
FIG. 1 is an upper perspective view of a multi-adjustment cervical pillow according to the present invention, with four fasteners of the pillow engaged to place the pillow in a first configuration.
Figure 2:
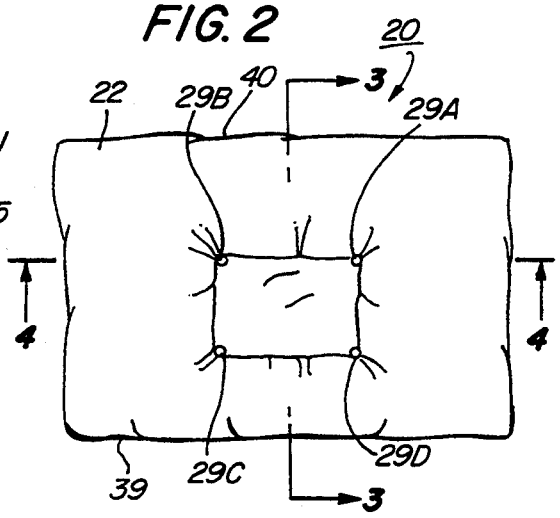
FIG. 2 is a lower plan view of the pillow of FIG. 1.

As shown in FIGS. 1 and 2, the pillow 20 according to the present invention includes a cover 20A comprising an upper generally rectangularly shaped fabric cover panel 21 sewn on its periphery to a lower fabric cover panel 22 along a peripheral seam 23. Preferably, cover panel 21 has an opening 24 closable by a zipper fastener 25 to facilitate insertion or removal of filler material 26 into hollow interior space 27 formed between upper and lower cover panels 21 and 22. As shown in FIG. 1, zipper 25 is disposed parallel to and a short distance inward of an outer transverse edge 28 of pillow 20.

Although cover 20A may be made from a variety of fabrics, it is necessary that the fabric be sufficiently porous to permit breathing through the fabric, to prevent the possibility of suffocation. In the preferred embodiment, cover 20A is made from a woven cotton fabric having a thread count of about 80.

Figure 2A:
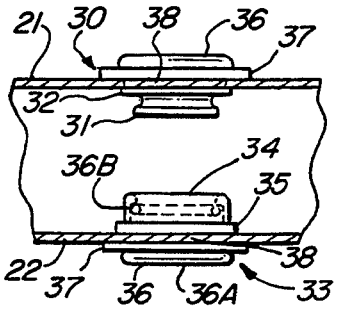
FIG. 2A is an enlarged, partly sectional view of a portion of the pillow of FIG. 1.
Figure 3:
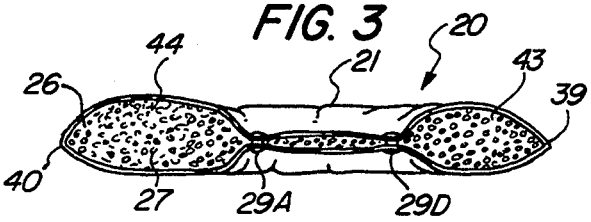
FIG. 3 is a transverse sectional view of the pillow of FIG. 1, taken along line 3—3.
Figure 4:
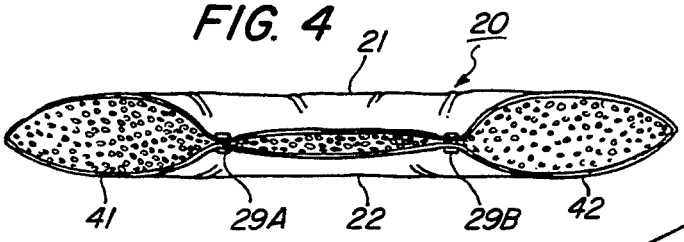
FIG. 4 is a longitudinal sectional view of the pillow of FIG. 1, taken along line 4—4.

Referring now to FIGS. 1, 2 and 3, it may be seen that upper and lower cover panels 21 and 22 are provided with a plurality of vertically aligned pairs of fasteners 29. As may be seen best by referring to FIG. 2A, in the preferred embodiment, each fastener pair 29 is a snap fastener, consisting of a first fastener member 30 having a ball or post 31 protruding outward from a circular base flange 32, and a second fastener member 33 having a socket 34 protruding outward from a circular base flange 35 adapted to snappingly receive post 31. As shown in FIGS. 1, 2 and 2A, each fastener 30 and 33 is attached to cover 20A by a rivet 36 that has an outer flat circular base 36A, and a post 36B that is inserted through a fabric washer 37 and hole 38 through cover 20A. Rivet 36 is secured to a respective inner flange 32 or 35 by clinching post 36B. Of course, other types of equivalent fastener pairs such as complementary halves of a fabric hook and loop fastener could be used in place of snap fastener pairs 29.

As shown in FIGS. 1 and 2, fasteners 29 are arrayed in a rectangular pattern. In the preferred embodiment, one row of fasteners 29C and 29D is located inwards a short distance inward from and parallel to a first longitudinal edge 39 of pillow 20. (As shown in FIG. 1, edge 39 of pillow 20 is in front.) A second row of fasteners 29A and 29B transversely aligned with fasteners 29D and 29C, respectively, lie on a row parallel to a second longitudinal edge wall 40 of pillow 20. This row of fasteners is spaced further apart from rear longitudinal edge wall 40 than are fasteners 29C and 29D from front longitudinal edge wall 39. Thus, as may be seen best by referring to FIGS. 1 and 4, with all four fasteners 29A, 29B, 29C and 29D closed, pillow 20 has a shape configuration having left and right transversely disposed oval tubular sections 41 and 42 of equal length and width. In this configuration, pillow 20 also has a relatively narrow longitudinally disposed front tubular section 43, and a relatively wide longitudinally disposed rear tubular section 44, as shown in FIG. 3.

Configuration #1 of pillow 20 shown in FIGS. 1–4 is recommended for most people of medium to large build, and for persons who sleep alternately on their back and side during the course of a sleeping session. As may be seen best by referring to FIG. 3, in configuration #1 of pillow 20, the neck may be placed on narrow front tubular section 43, with the head placed in the central portion generally defined by the rectangular area of upper cover panel 21 inward of fasteners 29. This arrangement provides narrow and firm support for the neck. Alternatively, pillow 20 may be rotated 180 degrees and the neck placed on wider tubular section 44. This arrangement provides wider and firm support.

In the preferred embodiment of pillow 20, filler material 26 within hollow interior space 27 of the pillow is a flowable material. The present inventor has found that a particularly effective choice of flowable filler material 26 for pillow 20 is buckwheat hulls. For configuration #1 and other configurations of pillow 20 to be discussed, snap fastener halves 30 and 33 of a fastener pair 29 are snapped together by first holding pillow 20 up on an edge and letting the hulls fall to an end or side of the pillow away from the fastener pairs. Finger pressure is then applied to the outer circular bases 36 of a selected fastener pair 29 sufficient to cause a post 31 of post fastener member 30 to be snappingly received by a socket 34 of socket fastener member 33.

Figure 5:
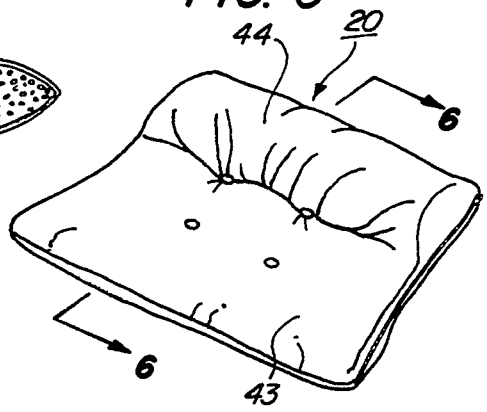
FIG. 5 is an upper perspective view of the pillow of FIG. 1, with a first row of fasteners engaged to place the pillow in a second configuration.
Figure 6:
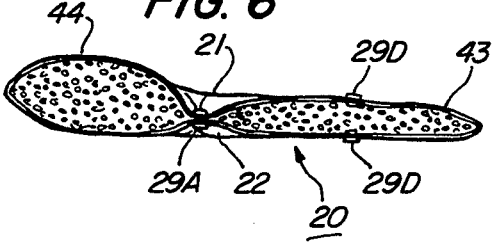
FIG. 6 is a transverse sectional view of the pillow configured as shown in FIG. 5.

FIGS. 5 and 6 illustrate a second configuration of pillow 20. In this configuration, fasteners 29A and 29B spaced wide apart from longitudinal edge 40 of pillow 20 are snapped together to form a relatively wide tubular section 44. With pillow 20 turned 180 degrees from the position shown in FIG. 1 to the position shown in FIG. 5, the wide tubular section 44 provides support suitable for persons having a small to medium build with average to large neck, or for those preferring a little less support for head lift than configuration #1 shown in FIGS. 1–4. As may be seen best by referring to FIG. 6, the buckwheat hulls comprising filler material 26 are shifted to tubular neck support section 44 before the pillow is slept on.

Figure 7:
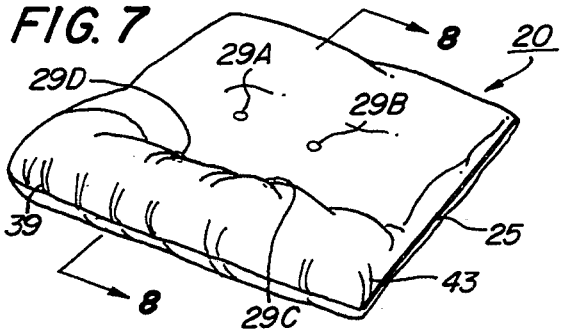
FIG. 7 is an upper perspective view of the pillow of FIG. 1, with a second row of fasteners engaged to place the pillow in a third configuration.
Figure 8:
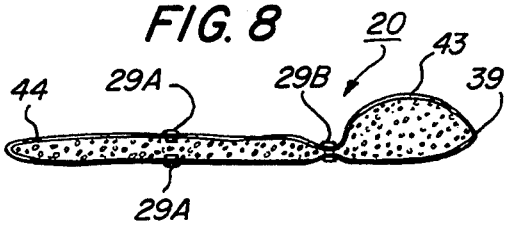
FIG. 8 is a transverse sectional view of the pillow configured as shown in FIG. 7.

FIGS. 7 and 8 illustrate a third configuration of pillow 20. In this configuration, fasteners 29C and 29D spaced close to longitudinal edge 39 of pillow 20 are snapped together to form a relatively narrow tubular section 43. In this configuration, narrow tubular section 43, which provides somewhat less neck support, is suitable for use by persons having a shorter to average length neck, or those preferring a little less support. This configuration also provides a little less head lift than configuration #1. As may be seen best by referring to FIG. 8, the buckwheat hulls comprising filler material 26 are shifted to tubular neck support section 43 before the pillow is slept on.

Figure 9:
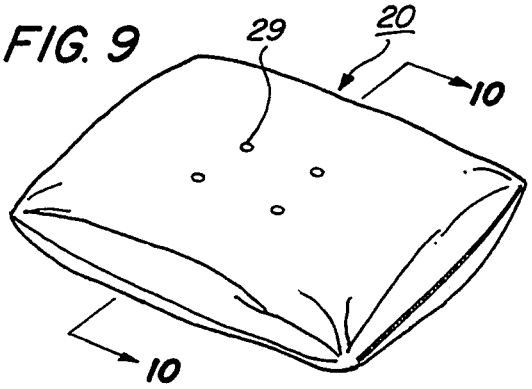
FIG. 9 is an upper perspective view of the pillow of FIG. 1, with all of the fasteners of the pillow disengaged to place the pillow in a fourth configuration.
Figure 10:
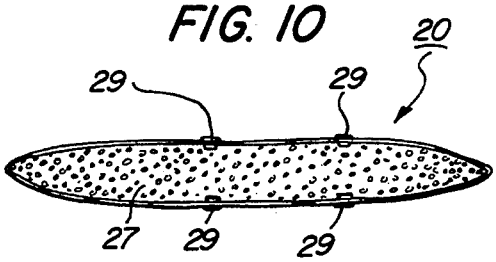
FIG. 10 is a transverse sectional view of the pillow configured as shown in FIG. 9.

FIGS. 9 and 10 illustrate a fourth configuration of pillow 20. In this configuration, all four fasteners 29 are unsnapped, thus de-compartmentalizing hollow interior space 27 of pillow 20. This configuration provides the least amount of differential neck support.

Figure 11:
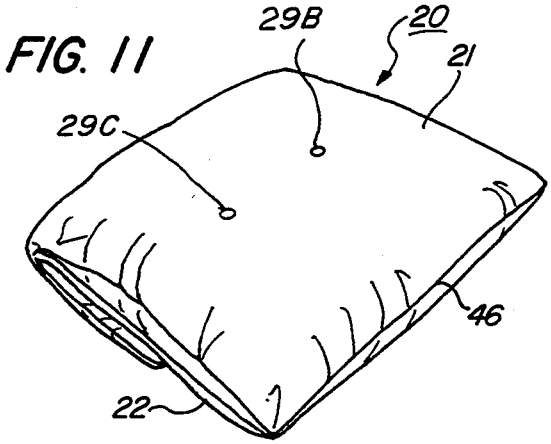
FIG. 11 is an upper perspective view of the pillow of FIG. 1, with a first column of fasteners engaged to place the pillow in a fifth configuration.

FIG. 11 illustrates a fifth configuration of pillow 20. In this configuration, a column of fasteners 29A and 29D adjacent zipper 25 near left transverse edge 28 of pillow 20 are snapped. Then, as shown in FIG. 11, all of the buckwheat hulls comprising filler material 26 are shifted towards the right transverse edge 46 of pillow 20. That portion of pillow 20 to the left of closed fasteners 29A and 29D is then folded under lower cover panel 22, and the folded end then inserted into a pillowcase to retain the pillow in a folded-over position. This configuration provides extra pillow height, and would be used primarily by persons who sleep exclusively on their sides, since the extra head lift provided by this configuration would stress the neck if a person would sleep on their back in this configuration.

Figure 12A:
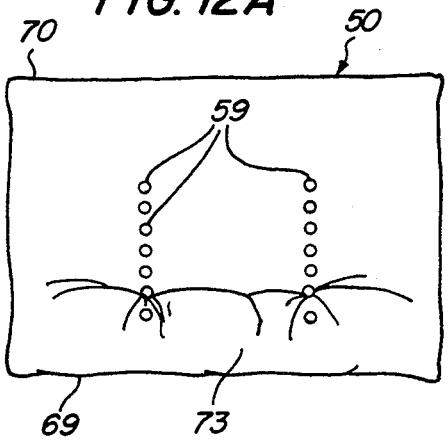
FIG. 12A is an upper plan view of a second embodiment of a pillow according to the present invention, utilizing more than two rows of fasteners.

FIG. 12A shows a second embodiment 50 of a multi-adjustment cervical pillow according to the present invention. Pillow 50 has a plurality of rows of fasteners 59, of a greater number than the two rows of fasteners 29 on the basic embodiment 20 shown in FIG. 1. The additional rows of fasteners 59 allows the formation of a range of narrow tubular neck support sections 73 of various widths. Preferably, the rear row of fasteners 59 of pillow 50 is further from rear longitudinal edge 70 of the pillow than the spacing between the front row of fasteners and the front longitudinal edge 69 of the pillow.

Figure 12B:
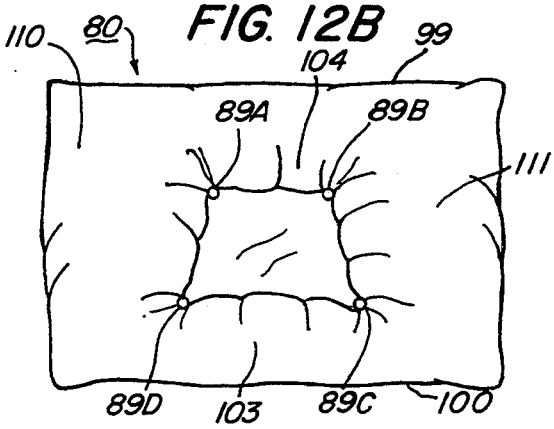
FIG. 12B is an upper plan view of a third embodiment of a pillow according to the present invention, utilizing fasteners positioned in a non-rectangular array.

FIG. 12B shows a third embodiment 80 of a multi-adjustment cervical pillow according to the present invention. Pillow 80 has a first row of fasteners 89A and 89B parallel to the rear longitudinal edge 99 of the pillow, and a second row of fasteners 89D and 89C parallel to the front longitudinal edge 100 of the pillow. The lateral spacing between fasteners 89A and 89B is different from the lateral spacing between fasteners 89D and 89C. This arrangement allows the formation of left and right compartment sections 110 and 111 having a quadrilateral shape, in addition to front and rear tubular sections 103 and 104. Thus, the configuration of FIG. 12B would be useful for persons desiring additional anti-rotational head stability while sleeping on the back or greater head support while sleeping on the side.

Figure 12C:
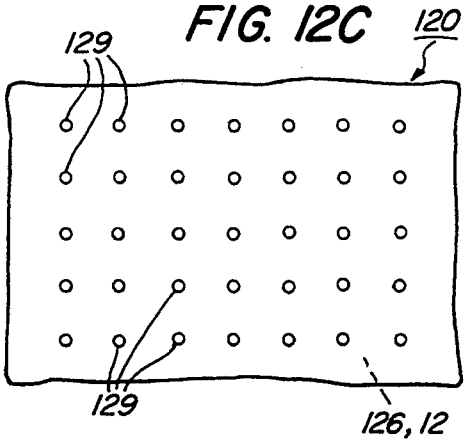
FIG. 12C is an upper plan view of a fourth embodiment of a pillow according to the present invention, utilizing more than two rows and more than two columns of fasteners arrayed in a rectangular matrix.

FIG. 12C illustrates a fourth embodiment 120 of a multi-adjustment cervical pillow or pad according to the present invention. In this variation, pillow or pad 120 has on upper and lower cover panels 121 and 122 thereof a plurality of vertically aligned fastener pairs 129 arranged in a matrix occupying a substantial portion of the surface area of the cover panels. With this arrangement, small isolated or contiguous regions of hollow rectangular interior space 127 of pillow or pad 120, defined by closed fastener pairs, may be partially evacuated of filler material 126, thus providing relief from or prevention of pressure sores by persons confined to wheelchairs or beds for extended periods of time.

Figure 13:
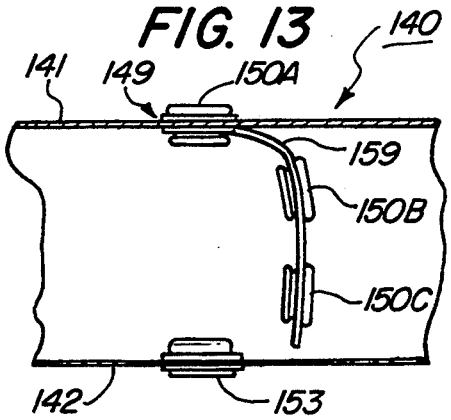
FIG. 13 is a fragmentary, partly sectional view of a first variation of an adjustable pillow according to the present invention, in which the spacing between upper and lower panel covers is adjustable.

FIG. 13 illustrates a first variation of various embodiments of a multi-adjustment cervical pillow according to the present invention discussed above. In this variation, a pillow 140 has an array of fastener pairs 129 in vertically aligned positions on the upper and lower cover panels 141 and 142, as in the embodiments of the pillow described above. However, one or more fasteners 129 of pillow 140 include means for adjusting the spacing between attached portions of upper and lower cover panels 141 and 142 to a selected one of a plurality of spacings. Thus, as shown in FIG. 13, a first half 150A of internal fastener pair 149 has attached thereto an elongated flexible strap 159 to which is affixed a plurality of additional longitudinally spaced apart fastener halves 150B and 150C. To space portions of upper and lower cover panels 141 and 142 adjacent fastener 149 as closely as possible, first connector pair half on the upper cover panel 150A is engaged with connector pair half 153 on the lower cover panel. If it is desired to space upper cover panel 141 a somewhat greater distance from lower cover panel 142, second connector pair half 150B on the intermediate portion of strap 159 is engaged with connector pair half 153. If a still greater spacing between upper and lower cover panels is desired, third connector pair half 150C near the end of strap 159 is engaged with connector pair half 153. As shown in FIG. 13, connector pair halves 150 on flexible strap 159 are post members of a snap fastener pair. Alternatively, socket members could be attached to strap 159, with a post member attached to the opposite panel cover.

Figure 14:
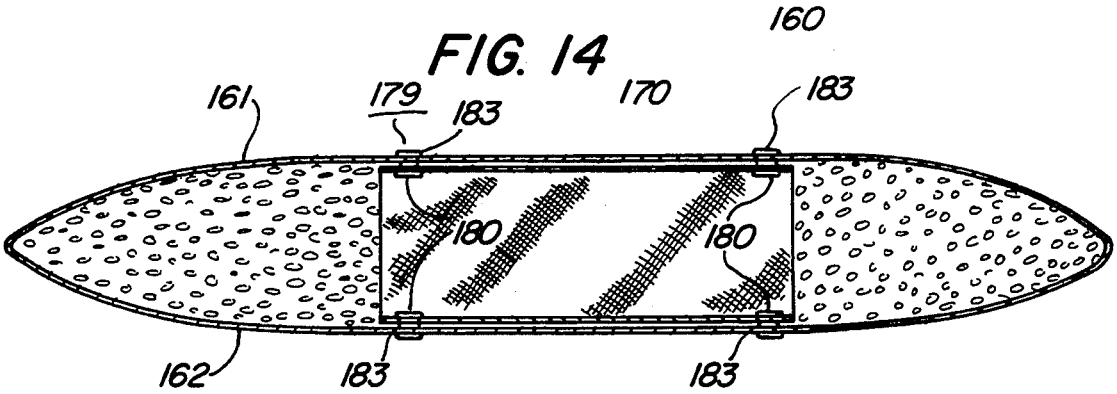
FIG. 14 is a fragmentary, partly sectional view of a second variation of an adjustable pillow according to the present invention, which incorporates a flow controlling barrier.

FIG. 14 illustrates a second variation of the pillows described above. In this variation, a pillow 160 constructed as described above for the basic embodiments includes an internal barrier to reduce or eliminate flow of filler material. Thus, as shown in FIG. 14, pillow 160 includes a laterally disposed flexible baffle panel 170 attached to the upper and lower cover panels 161 and 162 by means of snap fasteners 179 comprising post members 180 attached to corners of baffle panel 170, and socket members 183 fastened to vertically aligned locations on the inner facing surfaces of upper and lower cover panels 161 and 162.

Figure 15:
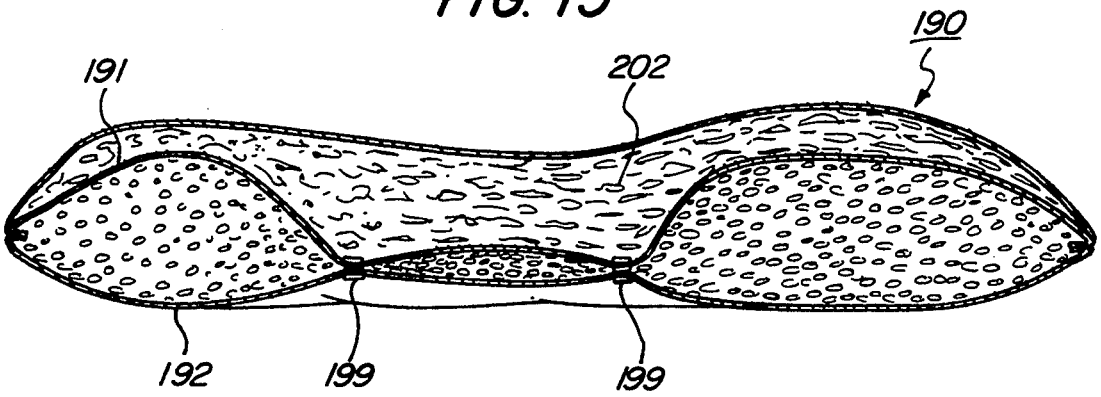
FIG. 15 is a fragmentary, partly sectional view of a third variation of an adjustable pillow according to the present invention, which incorporates a resilient cover.

FIG. 15 illustrates a third variation of the multi-adjustment cervical pillow described above. Pillow 190 has upper and lower covers 191 and 192, respectively, joinable by fasteners 199, and is fitted with a resilient cover 202 made of a material such as polyester fiber-fill covered with a third fabric panel sewn at the edges, or third and fourth fabric panels removably attached at the edges using snap fasteners.

What is claimed is:

1. A pillow comprising:

a. a cover made of a flexible material and having an upper cover panel joined to a lower cover panel to form a closed interior space, b. a yieldable solid filler material within said interior space, and c. a plurality of fasteners comprising vertically alignable pairs of fastener halves, said fastener halves being mutually engagable by external manipulation of said cover panels to join portions of said upper and lower cover panels at spaced apart locations, thereby subdividing said interior space within said pillow into subdivisions defined by regions of said upper and lower cover panels proximate joined fasteners and brought closer to one another than regions of said cover panels remote from said joined fasteners, thereby restricting flow of said filler material between said subdivisions.

2. The pillow of claim 1 wherein said fastener halves are further defined as a first type of fastener member attachable to said upper cover panel and a second type of fastener member attachable to said lower cover panel, said first and second fastener members being externally engageable with one another to hold adjacent portions of said upper and lower cover panels together, and externally disengageable to separate said adjacent portions of said cover panels.

3. The pillow of claim 2 wherein said cover is further defined as having a generally rectangular plan-view shape.

4. The pillow of claim 3 wherein said plurality of fasteners is further defined as being disposed in a rectangular matrix.

5. The pillow of claim 4 wherein said matrix is concentric with the perimeter of said cover.

6. The pillow of claim 3 wherein said plurality of fasteners is further defined as being disposed in a quadrilateral matrix, at least one first side of which is spaced closer to a first adjacent perimeter edge of said cover than the spacing between an opposite second side of said quadrilateral to a second opposite perimeter edge of said cover, whereby engaging fastener pairs in said first quadrilateral side forms with said first cover perimeter edge a first, narrow elongated, subdivision of said interior space of said pillow, and engaging fastener pairs in said second quadrilateral side forms with said second cover perimeter edge a second, wider elongated subdivision of said interior space of said pillow.

7. The pillow of claim 6 wherein said quadrilateral is further defined as being a rectangle.

8. The pillow of claim 7 wherein said rectangle is further defined as having a first longer side thereof parallel to and spaced apart a first distance from a first longer side of said cover, and a second longer side parallel to and spaced apart a second distance from a second longer side of said cover, said second distance being larger than said first distance.

9. The pillow of claim 1 wherein said filler material is further defined as being movable into and out of said subdivision formed in said interior space of said pillow by external manipulation of said pillow.

10. The pillow of claim 9 wherein said filler material is further defined as being flowable.

11. The pillow of claim 10 wherein said filler material is further defined as being buckwheat hulls.

12. A pillow comprising:

a. a first, upper fabric cover panel, b. a second, lower fabric cover panel substantially similar in shape and size to said upper cover panel, said lower cover panel positioned congruently beneath said upper cover panel and peripherally joined thereby to form a cover defining therewithin a closed interior space, c. a yieldable solid filler material within said interior space, d. a plurality of first type of said spaced apart fasteners attached to said upper cover panel, and e. a plurality of a second type of spaced apart fasteners attached to said lower cover panel, said second type of fastener being engageable with said first type of fastener exteriorly of said pillow cover to hold together selected spaced apart interior portions of said upper and lower cover panels, said spaced apart interior portions defining boundaries of subdivisions of said interior space of said pillow, said boundaries restricting flow of said solid filler material therethrough.

13. The pillow of claim 12 wherein at least one of said fastener members attached to a cover panel further includes attached thereto an elongated flexible strap having attached thereto a plurality of longitudinally spaced apart fasteners of the same type, whereby a selected one of said spaced apart fasteners may be engaged with a fastener member of the opposite type on the opposite cover panel, thereby allowing a portion of said upper cover panel to be secured at an adjustable spacing from said lower cover panel.

14. The pillow of claim 12 wherein said first and second type fasteners are further defined as complementary halves of snap fasteners of the type utilizing a post snapped into a socket.

15. The pillow of claim 12 wherein said filler material is further defined as being a flowable material.

16. The pillow of claim 15 further including external fasteners and an internal flexible baffle panel fastenable thereto for reducing the ease of flow of said filler material.

17. The pillow of claim 15 wherein said filler material is further defined as being buckwheat hulls.

18. The pillow of claim 12 wherein said pillow cover is further defined as having a rectangular shape.

19. The pillow of claim 12 wherein said plurality of fasteners is further defined as being disposed in at least two rows parallel to sides of said pillow cover, at least one of the rows being closer to an adjacent side of said pillow than the spacing between another row on the opposite side of said pillow cover.

20. The pillow of claim 19 wherein said first and second type of fastener members are further defined as being complementary halves of a snap fastener.

21. The pillow of claim 12 wherein said first and second fastener members are further defined as being complementary halves of a fabric hook and loop fastener.

* * * * *